United States Patent [19]

Gueret

[11] Patent Number: 4,962,627

[45] Date of Patent: Oct. 16, 1990

[54] METHOD FOR COMPACTING A POWDER-BASED COSMETIC PREPARATION

[75] Inventor: Jean-Louis Gueret, Paris, France

[73] Assignee: L'Oreal, Paris, France

[21] Appl. No.: 248,936

[22] Filed: Sep. 26, 1988

[30] Foreign Application Priority Data

Sep. 29, 1987 [FR] France ..... 8713425

[51] Int. Cl.[5] ..... B65B 1/24; B65B 63/08

[52] U.S. Cl. ..... 53/412; 53/436; 53/440

[58] Field of Search ..... 53/428, 436, 410, 412, 53/527, 242, 243, 440; 132/293; 215/2; 264/112; 206/581, 823; 141/12, 80, 82

[56] References Cited

U.S. PATENT DOCUMENTS

| | | | |
|---|---|---|---|
| 1,468,000 | 9/1923 | Buedingen | 206/823 x |
| 1,596,117 | 8/1926 | Pinkett | 100/93 D |
| 1,694,325 | 12/1928 | Kendall | 132/293 |
| 1,896,361 | 2/1933 | Hildebrand | 206/823 X |
| 2,173,227 | 9/1939 | Buckingham | 206/823 X |
| 2,260,456 | 10/1941 | Johnson | 141/80 |
| 2,365,920 | 12/1949 | Vaughn | 53/436 |
| 2,365,922 | 12/1944 | Vaughn | 53/428 |
| 2,731,777 | 1/1956 | Wollersheim | 53/436 |
| 3,103,224 | 9/1963 | Dearling | 206/823 X |
| 3,468,095 | 9/1969 | Vogt | 53/527 |
| 4,131,211 | 12/1978 | Corbic | 215/2 |
| 4,337,859 | 9/1969 | Murphy | 53/527 |
| 4,495,209 | 1/1985 | Whiteside | 215/2 |
| 4,660,608 | 4/1987 | Arai | 141/80 X |

FOREIGN PATENT DOCUMENTS

| | | | |
|---|---|---|---|
| 113137 | 6/1941 | Australia | 132/293 |
| 0191198 | 8/1986 | European Pat. Off. . | |
| 2573290 | 5/1986 | France . | |
| 274687 | 7/1927 | United Kingdom | 100/93 P |

*Primary Examiner*—John Sipos

*Attorney, Agent, or Firm*—Cushman, Darby & Cushman

[57] ABSTRACT

A quantity of powdered cosmetic preparation (2), which may include a binder, is placed in a container (1), which is open at its upper portion and the lower portion of which is defined by a tray (4) including an opening (9) and intended to contain the resultant compact cosmetic preparation at the end of the operation. In the region of the opening (9), the container (1) is defined by a counterpart base plate (3). The compression of the powdered preparation (2) is performed with the aid of a compacting piston (13), optionally heated. The surface of the compact cosmetic preparation, which is accessible through the opening (9), comprises the surface for takeup of the product by the user. By interposing a flexible backing (11) firmly attached to the tray (4) between the tray (4) and the counterpart plate (3), protection and tamper-proofing of the product can be obtained. The invention can be used for compacted makeup powders.

16 Claims, 1 Drawing Sheet

METHOD FOR COMPACTING A POWDER-BASED COSMETIC PREPARATION

FIELD OF THE INVENTION

The present invention relates to the field of cosmetic preparations comprised by dry compressed powders or mixtures of dry compressed powders, or mixtures of powder and anhydrous binders; these cosmetic preparations, which advantageously include colored or tinted pigments, are used in particular for making up the face and are often known as "compacts".

BACKGROUND OF THE INVENTION

It is generally known that this type of powder comprises a powdered base, selected in particular from the group including talc, rice starch, kaolin, silk powder or polymer powder, to which pigments are added to obtain a coloration, examples being the oxides of titanium, zinc or iron. If a pearly effect is desired, a mica powder or a powder of mica coated with metal oxides, in particular of titanium and bismuth, or aluminum powders is added. To obtain sufficient adherence to the skin, a small quantity of binder is typically added, for example vegetable, animal, mineral or synthetic oils, zinc stearate, sorbitol or lanolin. These powders may also contain preservatives such as methylparaben or propylparaben, surfactants (preferably nonionic), and fragrances.

To obtain a makeup compact, the fluid base powder is disposed on the bottom of a container, in which a piston or punch, which compresses the powder to assure the cohesion of its grains, is made to slide. In general, it is arranged that the container is defined at its bottom by a tray that receives the resulting compact product.

It has been found, however, that the compact product obtained is not homogeneous over its height, and in particular it is more friable in the region near the bottom of the tray, and is harder in the region on the opposite end, that is, on the surface to which the compacting piston is applied. The reason for this is that the pressure applied to the fluid powder is not transmitted perfectly through the layer of powder, because of the elasticity of the powder. Hence during use, it is easier to take up the powder in a more-friable portion.

SUMMARY OF THE INVENTION

In order to take advantage of this feature, the present advantage proposes a method by which packaging of the compact product can be obtained directly, in which package the user has access to the product via its more-friable portion. To this end, the tray placed in the bottom of the container has at least one opening, the container being defined at the level of the opening or openings by a counterpart base plate. Under these conditions, after the compacting operation, in a final package comprising a case, for example, the resultant tray is inverted, so that the product can be taken up through its opening or openings.

It has also been found, in performing compacting in the conventional manner, that the edges of the compacts often have flaws. With the method of the present invention, it is sufficient to dispose the opening or openings at the bottom of the tray, primarily in the central region thereof. In this manner, the edges of the compact are concealed in the final package, which lends a more esthetic appearance.

In a variant embodiment of the method according to the invention, a counterpart plate may be used, which corresponding to this opening is slightly convex, so that the compact extends beyond the bottom of the tray, through the opening or openings it it, along a slightly bulging portion, which also lends a more esthetic appearance to the compact as a whole.

Another advantage of this technique is that the aforementioned openings may be of any shape and hence may advantageously be creative or esthetic in shape, but in all cases, the same compacting piston for a tray of a given shape of complete compact can be used. It is sufficient simply to replace the tray each time, in the compacting system, with another tray that includes a different type of opening.

A protective film advantageously comprising a tamper-proof film for the powder may be interposed in the compacting system between the counterpart base plate and the tray. At least one transverse separator bar, which separatates the opening of the bottom of the tray into two zones may also be installed on the bottom of the tray in the compacting container, in such a manner that powders of different types, for example including pigments of different colors or shades, can be compacted in the same operation, in particular to include complementary makeup products.

Hot compacting can also be performed, in order to obtain better cohesion of the resultant compact product, which is important particularly in the case where the powder includes a binder which distributes better and more quickly in the base powder; the binder can also be used in microencapsulated form.

Hence the subject of the present invention is, first, a method for compacting a powder-based cosmetic preparation, by which a quantity of this powdered preparation is placed in a container that is open in its upper portion, and its lower portion is defined by a tray intended to contain the resultant compact cosmetic preparation at the end of the operation, in order with this resultant preparation to comprise an element for packaging the cosmetic preparation, and the compression of the powdered preparation is performed in this container, characterized in that a tray is used the base of which includes at least one opening, the container being defined in the region of the opening or openings by a counterpart base plate on which the tray rests; the surface of the compact cosmetic preparation, which is accessible through this opening or openings, comprises the surface at which, in the final compact cosmetic preparation package, the user takes up this preparation.

In particular, a tray can be used the opening or openings of which is or are made in a central portion of the bottom, the boundary region of the compact cosmetic preparation being protected from the outside, in the final package, by the peripheral zone on the bottom of the tray.

In a variant of the method according to the invention, a counterpart base plate is used the surface of which that faces the opening, or each opening, of the base of the tray is slightly concave, to obtain a slightly convex surface for the preparation that protrudes from the plane of the outer wall of the bottom of the tray.

In an important feature of the method according to the invention, a flexible protective backing capable of resting firmly on the tray and its contents after compacting can be disposed between the bottom of the perforated tray and the counterpart base plate. This backing must be made of an extremely flexible material, if the foregoing variant is used.

In particular, a backing that is fused or glued to the outer edge of the bottom of the tray, or a backing that is completely adhesive, can be used, this backing in this case making the compact cosmetic preparation tamperproof in its associated tray. In the case where the backing is completely adhesive, the surface of the compact product includes a slightly textured effect when the backing is removed, which may be esthetically desirable.

The use of a rigid lid instead of the flexible backing can also be provided, this lid being obtainable by injection and capable of being integrally attached to the bottom of the tray by snap-locking.

In another characteristic of the method according to the invention, at least one transverse bar separating powdered cosmetic preparations of different types may be disposed in the container, facing the counterpart plate and passing through the openings (or at least one of the openings) of the bottom of the tray, and these preparations can then be compacted simultaneously.

According to the invention, a film of liquid glue, for example thermofusible glue, can be disposed on the bottom of a case capable of receiving the tray containing the associated compact preparation and the bottom of the tray being turned toward the outside, and the glue can be made to harden in order to assure the fixation of the tray to the bottom of the case and to the inner lower edge of the side wall of the case, in order to make the final package of the compact preparation.

In a known manner, a powdered cosmetic preparation which includes a certain quantity of at least one binder, in particular from 2 to 15% by weight as a proportion of the total weight of powdered cosmetic preparation, is used. In particular, one or more binders packaged in microcapsules may be used, which explode upon compression, to distribute the binder throughout the particles of powder.

In an important characteristic of the present invention, hot compacting may be performed. In this case, a compacting piston equipped with a heating device is used in particular, and the temperature of the compacting piston is regulated to a value between 40° and 300° C., for example.

In the case where hot compacting is done and a binder is used, for a given cosmetic preparation, a proportion of binder lower than or equal to what would be selected for compacting without adding heat can be selected, in order to obtain a more powdery or more creamy texture, as desired, of the compact cosmetic preparation. Regardless of its form, the binder distributes better and faster throughout the composition; less of it can be used, for equal cohesion, with a more-powdery texture being obtained.

Moreover, in the case where compacting is done hot and at least one binder is used, binders having hydrophobic properties, such as waxes, which could not be used if heat were not added can be used; in this way, a more-hydrophobic compact can be obtained, to obtain a makeup that is more water-resistant.

The present invention also relates to the compact cosmetic preparations obtained by the above-described method.

The invention will be better understood from the ensuing detailed description of various exemplary embodiments, which are solely illustrative and not limiting, referring to the accompanying drawings.

DESCRIPTION OF THE PREFERRED EMBODIMENTS

Figure 1:
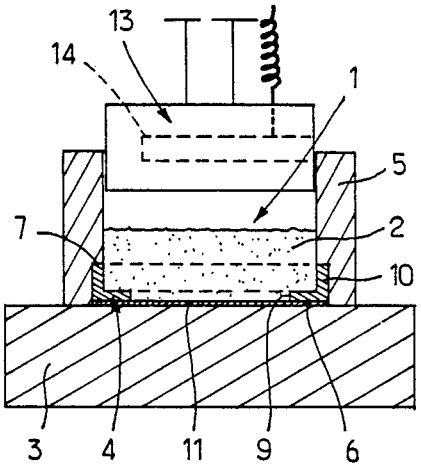
FIG. 1 is a schematic vertical sectional view through a compacting device adapted for performing the method according to the present invention.

Referring to FIG. 1, a container 1 is seen, in which a quantity of powder 2 intended to be compacted has been disposed.

The composition of this powder by weight may for example be as follows:

| | |
|---|---|
| talc | 40% |
| pigments | 10% |
| pearlizing agent (mica) | 40% |
| binder (liquid petrolatum, jojoba oil), optionally microencapsulated | 10% |

The container 1 is defined by a horizontal support 3, serving as a counterpart plate in the operation of compacting the powder 2, by a tray 4 resting on the counterpart plate 3, and by a tubular sleeve 5.

The tray 4, made of plastic, for example, comprises a rectangular bottom 6, to which a side wall 7 of low height is connected. The quantity of fluid powder 2 introduced, and the dimensions of the tray 4, are calculated so that the compacting will produce a flat parallelepiped block (see FIG. 3), the upper surface of which is flush with the free edge of the side wall 7 of the tray 4.

This latter has the particular characteristic that its bottom 6 includes an opening 9 of substantially ellipsoidal form, centered over the center of the bottom 6 and occupying a major surface area of this bottom.

The sleeve 5, of rectangular cross section corresponding to the inside cross section of the tray 4, has an undercut 10 in its inside wall, at a distance from one of its edges that is equal to the height of the tray 4.

For compacting, the tray 4 rests on the counterpart plate 3, with a backing 11 between them, the sleeve 5 being axially nested on the tray 4 in such a way that the free upper edge of the tray comes to abut the undercut 10; the inside surfaces of the wall 7 and sleeve 5 come to be located in the extension of one another.

The backing 11 is a backing of a very flexible plastic material; its shape and dimensions correspond to those of the bottom of the tray 4. In addition, it is extended laterally by a tab 12, as is readily visible in FIG. 2. The backing 11 is glued by its edge to the periphery of the outer wall of the bottom 6, or else it is adhesive over its entire surface.

A piston 13 is disposed slidably in the container 1. The piston is equipped with a heater device 14, for example an electrical resistor. This device 14 is optional and is shown in dotted lines in FIG. 1.

For the compacting, the piston 13 is applied to the powder 2, the level of which is higher than that of the upper edge of the tray 4, until the compact 8 is obtained. The compacting pressure is between 40 and 400 bars, and it is maintained for from 1 to 15 seconds. Next, after the piston is withdrawn and the sleeve 5 is removed, the unit shown in FIG. 2 is obtained, comprising the tray 4, the compact 8 and the backing 11.

Figure 3:
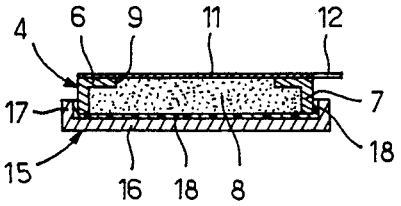
FIG. 3 is a longitudinal section showing the tray of FIG. 1 after emplacement in a presentation case.

This unit is then placed in inverted position, as shown in FIG. 3, into a case 15 the solid bottom 16 of which is connected to a side wall 17, the inside cross section of this case 15 being equal to or slightly larger than the cross section of the tray 4.

Figure 2:
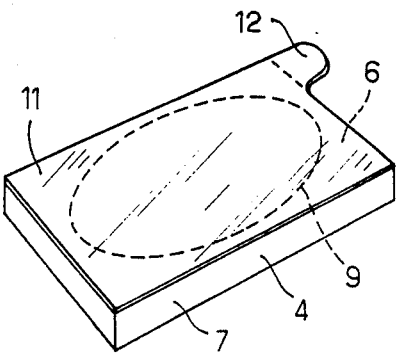
FIG. 2 is a perspective view of the tray containing the compact cosmetic preparation, such as is obtained at the end of the compacting operation by the device of FIG. 1, this tray being shown in the inverted position in order to show the side from which the compact product is taken up.

Before the unit shown in FIG. 2 is introduced, a film of thermofusible glue 18 in the liquid state is disposed on the bottom 16 of the case 15. The setting of this glue makes it possible to obtain the fixation of the compact 8 to the bottom 16 of the case 15; moreover, while it is still liquid the thermofusible glue 18 rises laterally up the wall 17, to assure totally firm joining of the tray 4 to the case 15.

At the time of use, the backing 11 is pulled off all in one piece, by grasping the tab 12, and access to the compact 8 is then available through the opening 9 of the tray. Access to the compact product is gained here through the least hard part of the compact 8, and hence, it is easier for the user to take up the product. Moreover, any flaws on the edge of the compact 8 are hidden from view, because this edge is covered by the periphery of the bottom 6.

In the package shown in FIG. 3, the gluing of the compact 8 to the bottom 16 of the case 15 prevents deleterious cracking of the compact 8 either during use, if the user presses on the compact 8, or during shipment.

Figure 4:
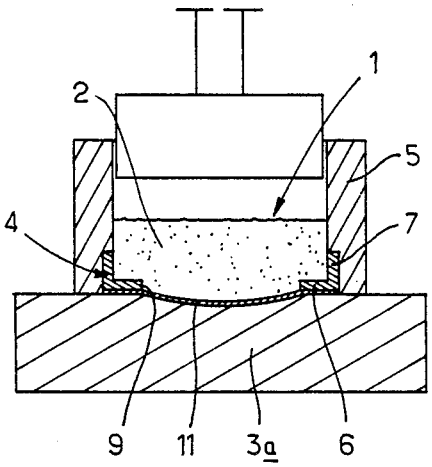
FIG. 4 is a view similar to FIG. 1 of a compacting device, in a variant embodiment.

In FIG. 4, a variant embodiment has been shown in which the counterpart plate 3*a* includes a slightly concave shape in its region that faces the opening 9 in the bottom 6 of the tray 4. In this way, a compact 8 is obtained that protrudes slightly through the opening 9, thus lending an esthetic effect to the resultant package.

Figure 5:
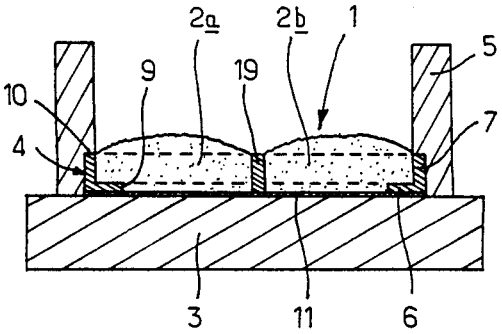
FIG. 5 is a view similar to FIG. 1, illustrating the possibility of making the trays with multiple compartments.
Figure 6:
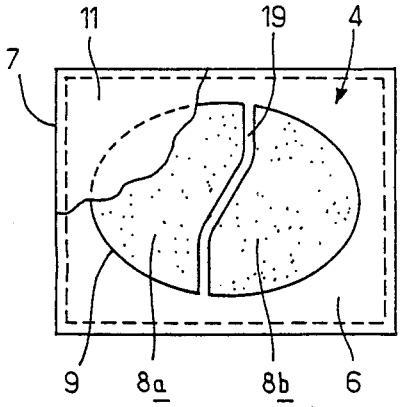
FIG. 6 is a plan view of the tray of FIG. 5, after compacting, showing the takeup surfaces of the compacted products in these compartments.

In FIG. 5, another possibility afforded by the present invention is illustrated, that is, the provision in the container 1, on the bottom 6 of the tray 4, of a transverse separator bar 19 provided between the edges of the bottom 6 defining the opening 9. This bar 19 comprises a means of separation making it possible to introduce two types of powdered substance 2*a*, 2*b* into the container, which for example differ in the color of pigments that they contain and for instance comprise complementary makeup products. The bar 19 may be curved or bent in shape, thus lending an esthetic note to the final packaging of the compact 8.

It will be understood that the embodiments described above are not in any way limiting and may be modified in any desirable manner without departing from the scope of the present invention.

What is claimed is:

1. A method of forming a non-viscous powder-based cosmetic preparation in a user package with the use of a tray for containing the preparation, the tray being of the type having a peripheral side wall and first and second spaced apart edges with the first edge surrounding a first opening and said second edge surrounding a second opening, the method comprising the steps of:

disposing said tray on a base plate with said first edge supported on said base plate;

filling said tray with the cosmetic preparation through said second opening including a binder from 2 to 15% by weight of the preparation; and compacting the preparation by application of pressure through said second opening, the pressure being between 40 and 400 bars into a solid state.

2. A method of forming a power-based cosmetic preparation in a user package with the use of a tray for containing the preparation, the tray being of the type having a peripheral side wall and first and second edges with said first edge surrounding a first opening and said second edge surrounding a second opening, the method comprising the steps of:

disposing said tray on a base plate with said first edge adjacent said base plate;

supporting said side wall in a support member having a receptacle area disposed over said second opening;

filing said receptacle area and said tray with the cosmetic preparation through said second opening including a binder from 2 to 15% by weight of the preparation; and compressing the cosmetic preparation in said receptacle area and tray to compact the cosmetic preparation through said second opening of said tray, said compressing occurring at a pressure between 40 and 400 bars into a solid state.

3. The method as claimed in claims 1 or 2 wherein the method includes the step of providing a flange about said first edge with said flange extending substantially perpendicularly from said side wall of said tray.

4. The method as claimed in claims 1 or 2 wherein said base plate has a portion facing said first opening of said tray and the method includes the step of providing a concave shaped recess in said base plate in said portion thereof to provide a slightly convex profile to the cosmetic preparation in carrying out said step of compressing the cosmetic preparation.

5. The method as claimed in claims 1 or 2 including the step of providing a flexible protective baking on said first opening of said tray prior to said filling step.

6. The method as claimed in claim 5 including the step of adhesively securing said backing to said first edge of said tray.

7. The method as claimed in claims 1 or 2 including the step of providing a transverse bar in said tray to divide the interior of said tray into two compartments and including the step of filling each said compartment with a different cosmetic preparation and simultaneously compacting both of the preparations.

8. The method as claimed in claims 1 or 2 including the step of adhesively securing a wall member to said second edge of said tray after said compressing step.

9. The method as claimed in claims 1 or 2 including the step of heating the cosmetic preparation during compressing.

10. The method as claimed in claim 9 including the step of using a compacting piston having a heating device for carrying out the compressing step.

11. A method as defined by claim 10 characterized in that the temperature of the compacting piston is regulated to a range between 40° and 300° C.

12. The method as claimed in claims 1 or 2 including the step of disposing a rigid lid on said first edge to cover said first opening after the compressing step.

13. A method as defined by one of the claim 5, characterized in that said backing (11) that can be pulled off all in one piece by a lateral pull tab (12) is used.

14. A method as defined by claims 1 or 2 characterized in that a powdered cosmetic preparation (2; 2*a*-2*b*) is used that includes from 2 to 15% by weight of at least one binder.

15. A method as defined by claim 14 characterized in that a binder packaged in microcapsules is used.

16. The method as claimed in claim 14 wherein said binder is hydrophobic.

* * * * *